US010790076B2

(12) United States Patent
Kuribayashi et al.

(10) Patent No.: US 10,790,076 B2
(45) Date of Patent: Sep. 29, 2020

(54) METHOD FOR PRODUCING RARE-EARTH MAGNETS, AND RARE-EARTH-COMPOUND APPLICATION DEVICE

(71) Applicant: SHIN-ETSU CHEMICAL CO., LTD., Tokyo (JP)

(72) Inventors: Yukihiro Kuribayashi, Echizen (JP); Shogo Kamiya, Echizen (JP); Harukazu Maegawa, Echizen (JP); Shintaro Tanaka, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 320 days.

(21) Appl. No.: 15/570,044

(22) PCT Filed: Apr. 18, 2016

(86) PCT No.: PCT/JP2016/062200
§ 371 (c)(1),
(2) Date: Oct. 27, 2017

(87) PCT Pub. No.: WO2016/175063
PCT Pub. Date: Nov. 3, 2016

(65) Prior Publication Data

US 2018/0114617 A1 Apr. 26, 2018

(30) Foreign Application Priority Data

Apr. 28, 2015 (JP) ..... 2015-092027

(51) Int. Cl.
*H01F 1/057* (2006.01)
*B22F 3/24* (2006.01)
(Continued)

(52) U.S. Cl.
CPC ..... *H01F 1/0577* (2013.01); *B05D 1/18* (2013.01); *B22F 3/00* (2013.01); *B22F 3/24* (2013.01);
(Continued)

(58) Field of Classification Search
None
See application file for complete search history.

(56) References Cited

U.S. PATENT DOCUMENTS 7,559,996 B2 7/2009 Miyata et al.
8,377,233 B2 2/2013 Nakamura et al.
(Continued)

FOREIGN PATENT DOCUMENTS

JP 2000-255771 A 9/2000
JP 2001-518704 A 10/2001
(Continued)

OTHER PUBLICATIONS

Machine translation of JP2002-220675A. (Year: 2002).*
(Continued)

*Primary Examiner* — Xiaowei Su
(74) *Attorney, Agent, or Firm* — Birch, Stewart, Kolasch & Birch, LLP

(57) ABSTRACT

A fixed beam 2 along which magnet-body holding sections 22 are consecutively provided is disposed so as to pass through a slurry 1. Sintered magnet bodies m placed in the magnet-body holding sections 22 by movable beams 3 are conveyed by repeating an operation in which the sintered magnet bodies m are moved to the following magnet-body holding sections 22. While being conveyed, the sintered magnet bodies m are passed through the slurry 1 to apply the slurry thereto, and are subsequently dried to remove a solvent in the slurry and affix a powder in the slurry thereto, and, as a result, the powder is continuously applied to the
(Continued)

plurality of sintered magnet bodies. Accordingly, a rare-earth-compound powder can be uniformly applied to the surfaces of the sintered magnet bodies, and the amount of the slurry taken from a coating tank can be reduced to effectively decrease wasteful consumption.

9 Claims, 9 Drawing Sheets

(51) Int. Cl.

| | |
|---|---|
| ***C22C 33/02*** | (2006.01) |
| ***C21D 6/00*** | (2006.01) |
| ***B22F 3/00*** | (2006.01) |
| ***C22C 38/00*** | (2006.01) |
| ***H01F 41/02*** | (2006.01) |
| ***B05D 1/18*** | (2006.01) |
| ***C22C 38/02*** | (2006.01) |
| ***C22C 38/06*** | (2006.01) |
| ***C22C 38/16*** | (2006.01) |

(52) U.S. Cl.

CPC ..... *C21D 6/00* (2013.01); *C21D 6/008* (2013.01); *C22C 33/02* (2013.01); *C22C 38/00* (2013.01); *C22C 38/005* (2013.01); *C22C 38/02* (2013.01); *C22C 38/06* (2013.01); *C22C 38/16* (2013.01); *H01F 41/0253* (2013.01); *H01F 41/0293* (2013.01)

(56) References Cited

U.S. PATENT DOCUMENTS

| | | | | |
|---|---|---|---|---|
| 2002/0020470 | A1* | 2/2002 | Okumura | B30B 15/0082 148/108 |
| 2008/0245442 | A1* | 10/2008 | Nakamura | B22F 9/023 148/101 |
| 2009/0098006 | A1 | 4/2009 | Nakamura et al. | |
| 2012/0139388 | A1 | 6/2012 | Iwasaki et al. | |
| 2013/0271248 | A1* | 10/2013 | Nagata | H01F 41/0293 335/302 |

FOREIGN PATENT DOCUMENTS

| | | | | | |
|---|---|---|---|---|---|
| JP | 2002220675 | A | * | 8/2002 | H01F 41/026 |
| JP | 2003-59741 | A | | 2/2003 | |
| JP | 2007-53351 | A | | 3/2007 | |
| JP | 2007-284738 | A | | 11/2007 | |
| WO | WO 99/17342 | A1 | | 4/1999 | |
| WO | WO 2006/043348 | A1 | | 4/2006 | |
| WO | WO 2011/108704 | A1 | | 9/2011 | |

OTHER PUBLICATIONS

International Search Report issued in PCT/JP2016/062200 (PCT/ISA/210), dated Jul. 19, 2016.
Written Opinion of the International Searching Auhtority issued in PCT/JP2016/062200 (PCT/ISA/237), dated Jul. 19, 2016.
Extended European Search Report for European Application No. 16786340.6, dated Nov. 8, 2018.
U.S. Appl. No. 15/570,233, filed Oct. 27, 2017, Unassigned.
U.S. Appl. No. 15/570,223, filed Oct. 27, 2017, Unassigned.
U.S. Appl. No. 15/569,881, filed Oct. 27, 2017, Unassigned.
U.S. Appl. No. 15/570,243, filed Oct. 27, 2017, Unassigned.
U.S. Appl. No. 15/569,888, filed Oct. 27, 2017, Unassigned.
U.S. Appl. No. 15/570,202, filed Oct. 27, 2017, Unassigned.
U.S. Appl. No. 15/569,982, filed Oct. 27, 2017, Unassigned.

* cited by examiner

METHOD FOR PRODUCING RARE-EARTH MAGNETS, AND RARE-EARTH-COMPOUND APPLICATION DEVICE

TECHNICAL FIELD

The present invention relates to a production method of rare earth magnets, which, upon production of the rare earth permanent magnets by coating sintered magnet bodies with a powder of one or more rare earth compounds and subjecting the resulting sintered magnet bodies to heat treatment to cause absorption of one or more rare earth elements into the sintered magnet bodies, can uniformly and efficiently coat the powder of the one or more rare earth compounds to efficiently obtain rare earth magnets having excellent magnetic properties, and also to a coating device for coating application of one or more rare earth compounds, which can be preferably used in the production method of the rare earth magnets.

BACKGROUND ART

Rare earth permanent magnets, such as Nd—Fe—B, are finding ever widening applications for their excellent magnetic properties. As a method for providing such rare earth magnets with further improved coercivity, it is known to obtain rare earth permanent magnets by coating surfaces of sintered magnet bodies with a powder of one or more rare earth compounds and subjecting the resulting sintered magnet bodies to heat treatment to cause absorption and diffusion of one or more rare earth elements into the sintered magnet bodies (Patent Document 1: JP-A 2007-53351 and Patent Document 2: WO 2006/043348). According to this method, it is possible to enhance coercivity while reducing a decrease in remanence.

For the coating application of such rare earth compound or compounds, it has been a conventional common practice to coat sintered magnet bodies with a slurry, in which a powder of the rare earth compound or compounds is dispersed in water or an organic solvent, by dipping the sintered magnet bodies in the slurry or spraying the slurry onto the sintered magnet bodies, and then to dry the resulting sintered magnet bodies. In this case, especially when conducting the dip coating, it is general from the viewpoint of productivity to adopt a net conveyor transport system that continuously performs coating on sintered magnet bodies by continuously transporting the sintered magnet bodies with a net conveyor.

Described specifically, as illustrated in FIG. 10, the net conveyor transport system coats the powder of the rare earth compound or compounds by placing a plurality of sintered magnet bodies m at predetermined intervals on a net conveyor c, continuously transporting the sintered magnet bodies m, passing the sintered magnet bodies m through the slurry 1 contained in a coating bath tin the course of the transport to dip-coat the sintered magnet bodies m with the slurry 1, pulling the sintered magnet bodies m out of the slurry 1, further transporting the sintered magnet bodies m while being placed on the net conveyor c, and passing and drying the resulting sintered magnet bodies m through a drying zone d, in which drying means such as a blower is arranged, to remove the solvent from the coated slurry.

With this net conveyor transport system, however, during a coating operation such as upon submergence into the slurry 1, during dipping and upon pulling out of the slurry 1, the sintered magnet bodies m tend to move on a conveyor, and therefore the sintered magnet bodies m tend to contact with one another to develop coating defects at contact surfaces.

Further, the transport system is prone to the development of mechanical troubles due to sticking and deposit of the slurry 1. Furthermore, the slurry 1 tends to be carried out of the coating bath t by a conveyor belt and hence to develop inconvenience such as wasteful consumption of the valuable rare earth compound or compounds.

It is, accordingly, desired to develop a coating method that can perform uniform and efficient coating application of a powder of one or more rare earth compound or compounds, can decrease the wasteful consumption of a slurry, and moreover can effectively avoid the occurrence of mechanical troubles.

PRIOR ART DOCUMENTS

Patent Documents

Patent Document 1: JP-A 2007-53351
Patent Document 2: WO 2006/043348

SUMMARY OF THE INVENTION

Problems to be Solved by the Invention

With the above circumstances in view, the present invention has, as objects thereof, the provision of a production method of rare earth magnets, which, upon production of rare earth permanent magnets by coating sintered magnet bodies of an $R^1$—Fe—B composition ($R^1$ is one or more elements selected from rare earth elements including Y and Sc) with a slurry, in which a powder of one or more compounds selected from oxides, fluorides, oxyfluorides, hydroxides and hydrides of $R^2$ ($R^2$ is one or more elements selected from rare earth elements including Y and Sc) is dispersed in a solvent, drying the resulting sintered magnet bodies to coat surfaces of the sintered magnet bodies with the powder, and subjecting the resulting sintered magnet bodies to heat treatment to cause absorption of $R^2$ into the sintered magnet bodies, can perform uniform and sure coating application of the powder, can decrease wasteful consumption of the slurry, and moreover can effectively avoid occurrence of mechanical troubles, and also a coating device for coating application of the one or more rare earth compounds, which can be suitably used in the production method of the rare earth magnets.

Means for Solving the Problems

To achieve one of the above-described objects, the present invention provides the following production methods [1] to [6] of rare earth magnets.

[1] A method for producing rare earth permanent magnets by coating sintered magnet bodies of an $R^1$—Fe—B composition ($R^1$ is one or more elements selected from rare earth elements including Y and Sc) with a slurry in which a powder of one or more compounds selected from oxides, fluorides, oxyfluorides, hydroxides and hydrides of $R^2$ ($R^2$ is one or more elements selected from rare earth elements including Y and Sc) is dispersed in a solvent, drying the resulting sintered magnet bodies to coat surfaces of the sintered magnet bodies with the powder, and subjecting the resulting sintered magnet bodies to heat treatment to cause absorption of $R^2$ into the sintered magnet bodies, the method including:

disposing a fixed beam having a number of magnet body holding portions, which are provided consecutively at equal intervals and on which the sintered magnet bodies are to be placed, so that a section of the fixed beam extends through the slurry;

repeating operations of lifting the sintered magnet bodies placed on the magnet body holding portions, moving the sintered magnet bodies forward, and placing the sintered magnet bodies on the next magnet body holding portions, all by moving beams disposed along the fixed beam, whereby the sintered magnet bodies are continuously transported along the fixed beam;

allowing the individual sintered magnet bodies to pass through the slurry in a course of the transport thereof to coat the individual sintered magnet bodies with the slurry; and further, drying the resulting sintered magnet bodies while transporting the sintered magnet bodies, whereby the powder is continuously deposited on the sintered magnet bodies.

[2] The production method of [1], in which a coating process of passing the sintered magnet bodies through the slurry to coat the sintered magnet bodies with the slurry and drying the resulting sintered magnet bodies is repeated a plurality of times.

[3] The production method of [1] or [2], in which the drying processing is conducted after removing residual drips from each sintered magnet body, which has been passed through the slurry and coated with the slurry, by ejecting air against the sintered magnet body.

[4] The production method of any one of [1] to [3], in which the drying processing is conducted by ejecting, against a rare earth magnet, air of a temperature within ±50° C. of a boiling point ($T_B$) of a solvent that forms the slurry.

[5] The production method of any one of [1] to [4], in which the heat treatment is applied to each sintered magnet body, which has been coated with the powder, in vacuo or in an inert gas at a temperature up to a sintering temperature for the sintered magnet body.

[6] The production method of any one of [1] to [5], further including:

applying, after the heat treatment, aging treatment at a low temperature.

In addition, to achieve one of the above-described objects, the present invention provides rare-earth-compound coating device of the following paragraphs [7] to [15].

[7] A device for coating sintered magnet bodies of an $R^1$—Fe—B composition ($R^1$ is one or more elements selected from rare earth elements including Y and Sc) with a powder of one or more rare earth compounds selected from oxides, fluorides, oxyfluorides, hydroxides and hydrides of $R^2$ ($R^2$ is one or more elements selected from rare earth elements including Y and Sc) upon production of rare earth permanent magnets by coating the sintered magnet bodies with a slurry of the powder dispersed in a solvent, drying the resulting sintered magnet bodies to coat surfaces of the sintered magnet bodies with the powder, and subjecting the resulting sintered magnet bodies to heat treatment to cause absorption of $R^2$ into the sintered magnet bodies, the device including:

a coating bath with the slurry contained therein;

a fixed beam having a number of magnet body holding portions, which are provided consecutively at equal intervals and on which the sintered magnet bodies are to be placed, and disposed so that a section of the fixed beam extends through the slurry contained in the coating bath;

moving beams disposed along the fixed beam, and capable of repeating operations of lifting the sintered magnet bodies placed on the respective magnet body holding portions, moving the sintered magnet bodies forward, and placing the sintered magnet bodies on the next magnet body holding portions; and drying means for drying the sintered magnet bodies held on the magnet body holding portions of the fixed beam, in which the sintered magnet bodies are continuously transported along the fixed beam by repeating operations of placing the sintered magnet bodies on the respective magnet body holding portions of the fixed beam, and by the moving beams, lifting the sintered magnet bodies placed on the respective magnet body holding portions, moving the sintered magnet bodies forward and placing the sintered magnet bodies on the next magnet body holding portions, the individual sintered magnet bodies are passed through the slurry, which is contained in the coating bath, in a course of the transport thereof to coat the sintered magnet bodies with the slurry, and the resulting sintered magnet bodies are dried by the drying means while transporting the sintered magnet bodies, whereby the solvent is removed from the coated slurry to deposit the powder on surfaces of the sintered magnet bodies.

[8] The coating device of [7], further including:

residual drip removal means disposed between the coating bath and the drying means to eject air against each sintered magnet body under transport while sequentially moving from one to the next of the magnet body holding portions of the fixed beam so that residual drips of the slurry on the surface of the sintered magnet body are removed.

[9] The coating device of [7] or [8], further including:

a chamber enclosing therein a drying zone with the drying means disposed therein or both the drying zone and a residual drip removal zone with the residual drip removal means disposed therein; and dust collection means for drawing air inside the chamber to collect dust, whereby the powder of the one or more rare earth compounds removed from the surfaces of the sintered magnet body is recovered.

[10] The coating device of any one of [7] to [9], in which a plurality of modules, which each include the coating bath and the drying means, are disposed in series, and are configured so that a powder coating process from the coating of the slurry to the drying is repeated a plural number of times by passing the sintered magnet bodies through the plurality of modules by transport means formed of the fixed beam and the moving beams.

[11] The coating device of any one of [7] to [10], in which each magnet body holding portion includes a recessed portion formed in the fixed beam, and a plurality of projections formed on the recessed portion so that one of the sintered magnet bodies is held in the recessed portion while being placed on the projections.

[12] The coating device of any one of [7] to [11], in which the fixed beam is formed of a plurality of transport rails disposed in parallel to each other along a direction of transport, and the magnet body holding portions are formed astride the plurality of transport rails, and hold the sintered magnet bodies.

[13] The coating device of [12], in which the moving beams include a plural number of paired supporting rods, and each paired supporting rods each have a magnet body supporting portion bent in a hook shape, and the moving beams are configured to repeat operations of moving the supporting rods up and down and moving the supporting rods back and forth along the fixed beam, lifting the sintered magnet bodies placed on the respective magnet body holding portions of the fixed beam, moving the sintered magnet bodies forward, and placing the sintered magnet bodies on the next magnet body holding portions.

[14] The coating device of [12] or [13], in which the magnet body holding portions of the fixed beam or the magnet body supporting portions of the moving beams or both the magnet body holding portions of the fixed beam and the magnet body supporting portions of the moving beams are each provided with a stopper that prevents one of the sintered magnet bodies from shifting in a horizontal direction that crosses the direction of transport at right angles.

[15] The coating device of any one of [7] to [14], in which a plurality of transport paths, which are each configured of the fixed beam and the moving beams, are disposed side by side in parallel to each other, and are configured so that a powder coating process from the coating of the slurry to the drying is concurrently conducted for the sintered magnet bodies transported in a plural number of rows.

Therefore, the above-described production method and coating device according to the present invention continuously coat the sintered magnet bodies with the powder of the one or more rare earth compounds by transporting the sintered magnet bodies according to a so-called walking beam system, that is, holding the sintered magnet bodies on the magnet body holding portions provided consecutively at equal intervals on and along the fixed beam, transferring the sintered magnet bodies to the next magnet body holding portions by the moving beams, and in the course of the transport, passing the sintered magnet bodies through the slurry to dip-coat them with the slurry, removing residual drips from the resulting sintered magnet bodies as needed, and then drying the resulting sintered magnet bodies to remove the solvent from the coated slurry.

Advantageous Effects of the Invention

According to the present invention, it is configured to conduct dipping of sintered magnet bodies in a slurry and their drying while transporting them by the walking beam system. The individual sintered magnet bodies are, therefore, subjected to dipping processing and drying processing while being sequentially and stably held on the magnet body holding portions provided consecutively at equal intervals on and along the fixed beam. As a consequence, even during the coating of the slurry by passing the sintered magnet bodies through the slurry, the dipping processing can be conducted while preventing the sintered magnet bodies from movements for sure and maintaining the sintered magnet bodies almost fixed. Hence, the sintered magnet bodies can be prevented from coming into contact with one another for sure, occurrence of uncoated parts through mutual contact can be surely avoided, and the slurry can be coated uniformly without failure.

The transport of the sintered magnet bodies is performed by an operation of the moving beams, these moving beams can be formed from a wire material such as a metal wire as in Examples to be described subsequently herein, and moreover the moving beams that submerges into the slurry for the dipping of the sintered magnet bodies can be limited to only a few ones of the moving beams. Accordingly, the amount of the slurry contained in the slurry bath and to be carried out of the coating bath by the transport operation can be reduced, so that wasteful consumption of the slurry can be prevented as much as possible and mechanical troubles of the transport system due to sticking and deposit of the slurry and powder can be decreased. Further, as in Examples to be described subsequently herein, the moving beams, which submerges into the slurry, can be configured to avoid advancing into the drying zone, whereby the sticking and deposit of the slurry and powder can be prevented extremely effectively.

According to the production method and coating device of the present invention, the following advantageous effects can be also obtained.

1) In a conveyor system such as that illustrated in FIG. 10, the interior of a coating bath 11 needs to be formed as inclined slope parts at places where the net conveyor c submerges into the slurry 1 and exits from the slurry 1. This need leads to a cause of enlargement of the coating bath 11. In the present invention, however, as in the Examples to be described subsequently herein, it is unnecessary to make such consideration. It is sufficient if a coating bath of a capacity required corresponding to a processing capacity is provided. It is, therefore, possible to make smaller the coating bath and a slurry circulation system that stirs the slurry in the coating bath.
2) As in the Examples to be described subsequently herein, the removal step of residual drips and the drying step are free of any barrier against blowing of air, such as a conveyor belt like a net belt as seen in the conveyor transport system, and therefore the drying speed can be increased. As a consequence, a drying area that also includes the residual drip removal zone can be designed small.
3) Because both a coating bath zone and the drying zone can be made small for the reasons 1) and 2), the device can be designed small as a whole. Upon arrangement of a plurality of modules which are each formed of the device, the freedom of layout can be widened.

BRIEF DESCRIPTION OF THE DIAGRAMS

FIG. 1 FIG. 1(A) to FIG. 4(H) are schematic views illustrating a coating device according to one embodiment of the present invention and its operations, in which FIG. 1(A) and FIG. 1(B) illustrate an initial state and a state after a first action, respectively.

FIG. 2 FIG. 1(A) to FIG. 4(H) are the schematic views illustrating the coating device according to the one embodiment of the present invention and its operations, in which FIG. 2(C) and FIG. 2(D) illustrate a state after a second action and a state after a third action, respectively.

FIG. 3 FIG. 1(A) to FIG. 4(H) are the schematic views illustrating the coating device according to the one embodiment of the present invention and its operations, in which FIG. 3(E) and FIG. 3(F) illustrate a state after a fourth action and a state after a fifth action, respectively.

FIG. 4 FIG. 1(A) to FIG. 4(H) are the schematic views illustrating the coating device according to the one embodiment of the present invention and its operations, in which FIG. 4(G) and FIG. 4(H) illustrate a state after a sixth action and a state after a seventh action, respectively.

EMBODIMENT FOR CARRYING OUT THE INVENTION

Figure 1A:
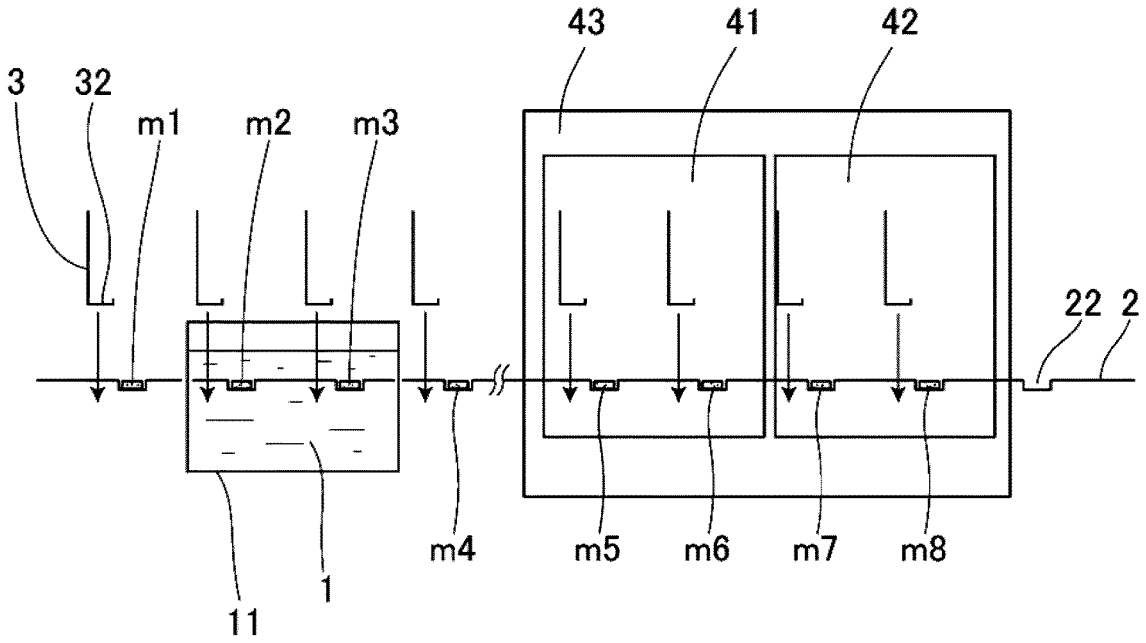

As described above, the production method of the present invention for rare earth magnets produces the rare earth magnets by coating sintered magnet bodies of an $R^1$—Fe—B composition ($R^1$ is one or more elements selected from rare earth elements including Y and Sc) with a powder of one or more of oxides, fluorides, oxyfluorides, hydroxides and hydrides of $R^2$ ($R^2$ is one or more elements selected from rare earth elements including Y and Sc) and subjecting the resulting sintered magnet bodies to heat treatment to cause absorption of $R^2$ into the sintered magnet bodies.

As the $R^1$—Fe—B sintered magnet bodies, those which have been obtained by a known method can be used. For example, the $R^1$—Fe—B sintered magnet bodies can be obtained by subjecting a mother alloy, which contains $R^1$, Fe and B, to coarse milling, fine pulverizing, forming and sintering in accordance with a usual method. It is to be noted that $R^1$ is, as described above, one or more elements selected from rare earth elements including Y and Sc, specifically one or more rare earth elements selected from Y, Sc, La, Ce, Pr, Nd, Sm, Eu, Gd, Tb, Dy, Ho, Er, Yb and Lu can be mentioned.

In the present invention, the $R^1$—Fe—B sintered magnet bodies are formed into a predetermined shape by grinding as needed, are coated at the surfaces thereof with the powder of one or more of the oxides, fluorides, oxyfluorides, hydroxides and hydrides of $R^2$, and are then subjected to heat treatment to cause absorptive diffusion (grain boundary diffusion) of $R^2$ into the sintered magnet bodies, whereby rare earth magnets are obtained.

$R^2$ is, as described above, one or more elements selected from rare earth elements including Y and Sc, and similar to $R^1$, one or more rare earth elements selected from Y, Sc, La, Ce, Pr, Nd, Sm, Eu, Gd, Tb, Dy, Ho, Er, Yb and Lu can be exemplified. Here, $R^2$ may include, but is not specifically limited to include, preferably at least 10 at %, more preferably at least 20 at %, notably at least 40 at % of Dy or Tb in total as the one or more rare earth elements. It is preferred from the objects of the present invention that at least 10 at % of Dy and/or Tb is included in $R^2$ as described above and the total concentration of Nd and Pr in $R^2$ is lower than the total concentration of Nd and Pr in $R^1$.

In the present invention, the coating of the powder is conducted by preparing a slurry with the powder dispersed in a solvent, coating surfaces of sintered magnet bodies with the slurry, and drying the resulting sintered magnet bodies. Here, the powder is not limited to any particular particle diameter, and may have a particle size that is common as a powder of one or more rare earth compounds for use in absorptive diffusion (grain boundary diffusion). Specifically, the average particle diameter may be preferably up to 100 μm, with up to 10 μm being more preferred. No particular limitation is imposed on its lower limit although at least 1 nm is preferred. This average particle diameter can be determined as a mass average particle size $D_{50}$ (specifically, a particle diameter or median diameter at 50% cumulative mass), for example, by using a particle size distribution analyzer that relies upon laser diffractometry. The solvent in which the powder is to be dispersed may be water or an organic solvent. As the organic solvent, no particular limitation is imposed, and ethanol, acetone, methanol, and isopropanol can be exemplified. Among these, ethanol is suitably used.

No particular limitation is imposed on the amount of the powder dispersed in the slurry. In the present invention, however, it is preferred to prepare a slurry with the amount of the dispersed powder being set at a mass fraction of at least 1%, notably at least 10%, specifically at least 20% for good and efficient coating of the powder. As an unduly great dispersed amount causes inconvenience such as unavailability of a uniform dispersion, the upper limit may be set at a mass fraction of preferably up to 70%, notably up to 60%, specifically up to 50%.

As the method for coating sintered magnet bodies with the slurry and drying the resulting sintered magnet bodies to coat the surfaces of the sintered magnet bodies with the powder, the present invention adopts the method that uses a fixed beam and moving beams, transports the sintered magnet bodies by the so-called walking beam system, and in the course of the transport, passing the sintered magnet bodies through the slurry to coat them with the slurry, and drying the resulting sintered magnet bodies. Specifically, the coating operations of the powder can be conducted using the coating device illustrated in FIGS. 1 through 9.

Specifically, FIGS. 1 to 4 are schematic views illustrating the coating device according to one embodiment of the present invention for coating application of one or more rare earth compounds and its operations. This coating device coats sintered magnet bodies m1 to m8 (which may hereinafter be collectively or individually designated by a reference sign "m") with the powder of the one or more rare earth compounds by transporting the sintered magnet bodies m by a transport device as a so-called walking beam system provided with a fixed beam 2 and moving beams 3, passing the sintered magnet bodies m through the slurry 1 contained in a coating bath 11 to coat them with the slurry 1, removing residual drips of the slurry in a residual drip removal zone 41, and then drying the resulting sintered magnet bodies m in a drying zone 42 to remove the solvent from the slurry 1.

The coating bath 11 is dimensioned to contain the slurry 1 as much as desired. This coating bath 11 may be provided, but is not specifically limited to being provided, additionally with a slurry circulation mechanism, which uses a suitable piping and pump arrangement, to circulate and stir the slurry.

Figure 5:
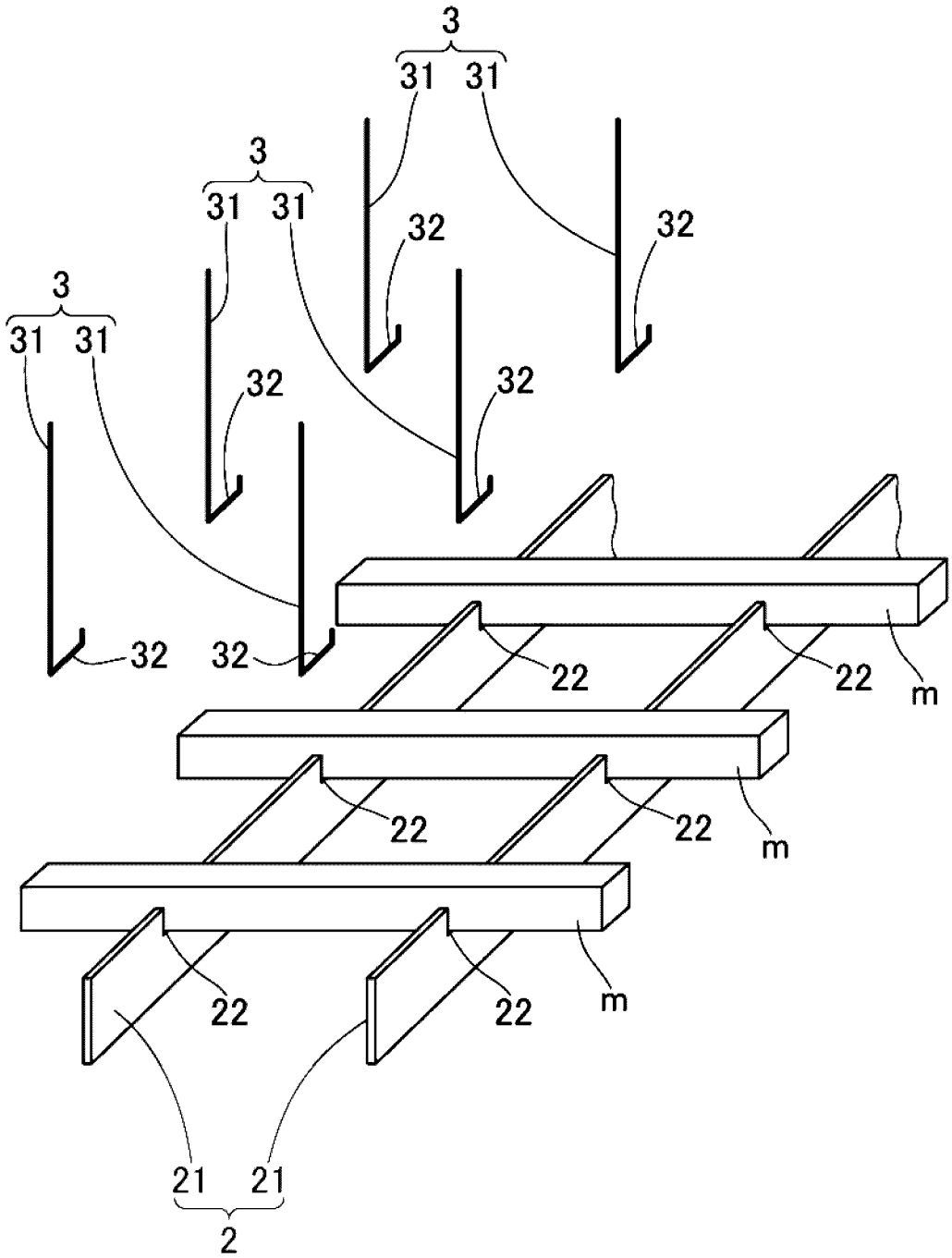
FIG. 5 is a fragmentary schematic perspective view illustrating correlations between a fixed beam and the moving beams, both of which constitute the coating device, and sintered magnet bodies.
Figure 6:
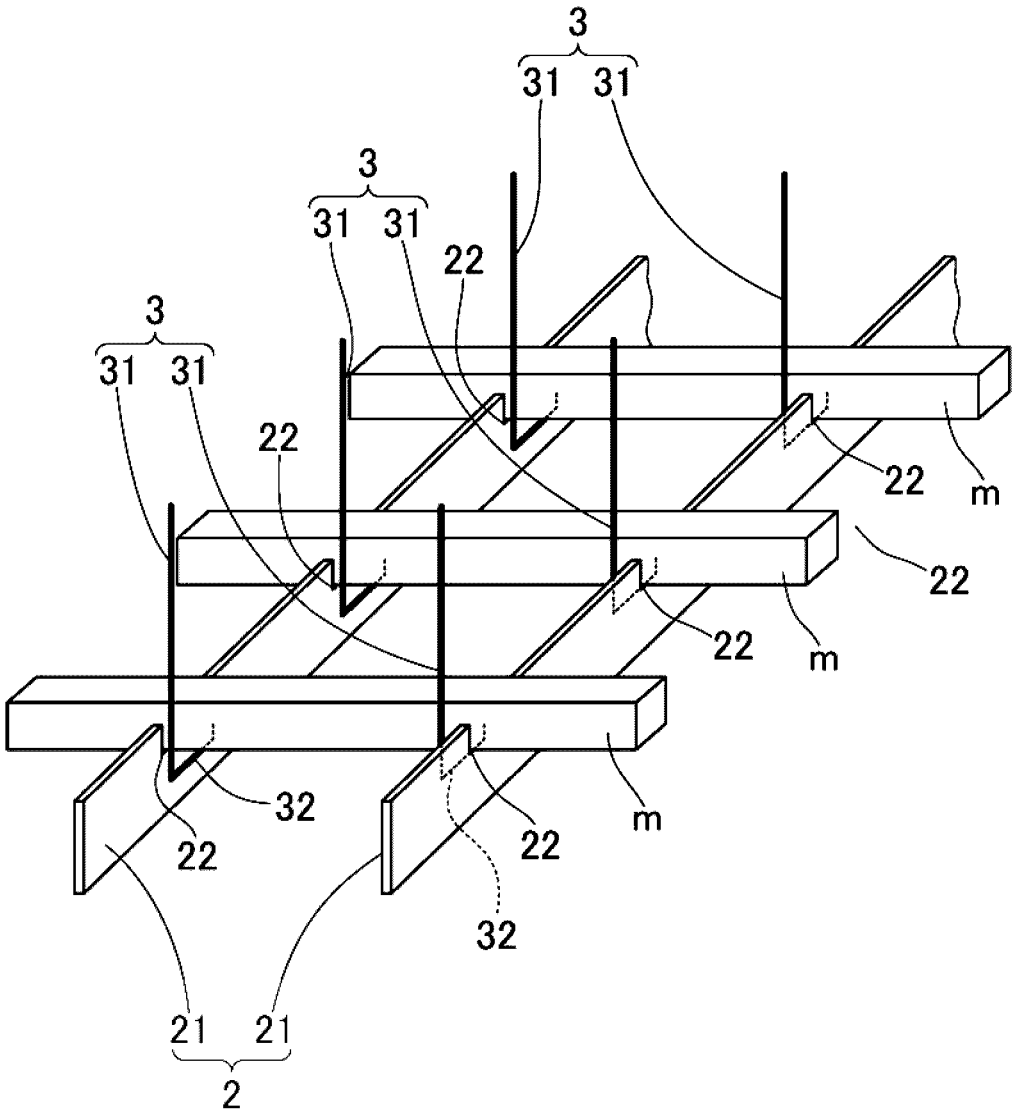
FIG. 6 is a fragmentary schematic perspective view illustrating correlations between the fixed beam and the moving beams, both of which constitute the coating device, and the sintered magnet bodies in a state different from that of FIG. 5.
Figure 7:
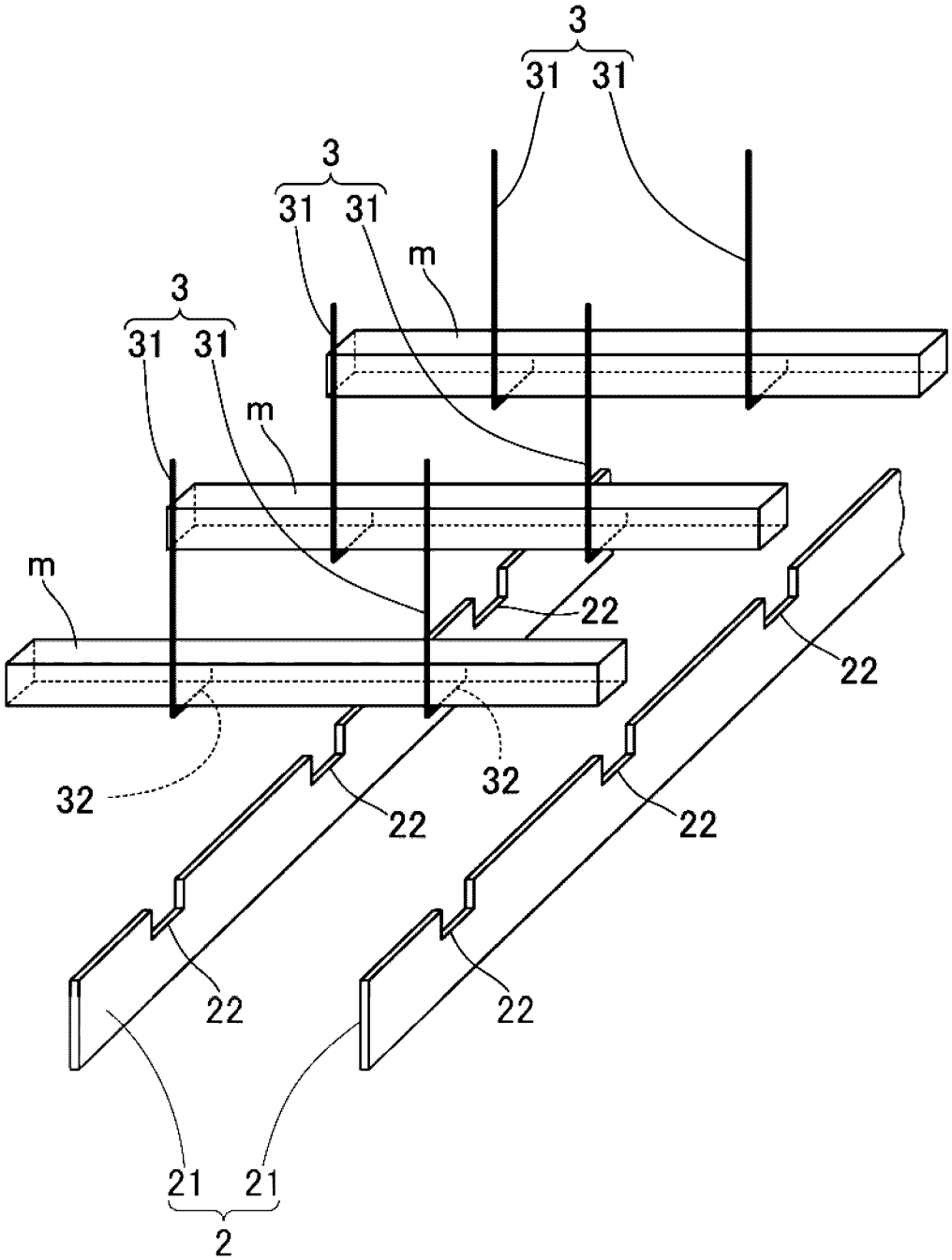
FIG. 7 is a fragmentary schematic perspective view illustrating correlations between the fixed beam and the moving beams, both of which constitute the coating device, and the sintered magnet bodies in a state different from those of FIGS. 5 and 6.

As illustrated in FIGS. 5 to 7, the fixed beam 2 is formed of a pair of transport rails 21 disposed side by side horizontally. As these transport rails 21, elongated thin plates are disposed and fixed horizontally with their widths extending in an up and down direction. In and along upper edge parts of the respective transport rails 21, square U-shaped notches 22 are consecutively provided at equal intervals. These notches 22 are formed in pairs at laterally corresponding locations of the respective transport rails 21, and magnet body holding portions 22 are formed by the paired corresponding notches 22 of the respective transport rails 21, whereby the sintered magnet bodies m are held on the magnet body holding portions 22 with the sintered magnet bodies m extending astride the respective transport rails 21. It is to be noted that the magnet body holding portions formed by the respective paired notches 22, are also designated by the reference numeral 22 in this embodiment. In the device of this embodiment, the square U-shaped, magnet body holding portions 22 are provided at equal intervals in the upper edge parts of the paired transport rails 21 as the fixed beam 2 as described above.

Figure 8:
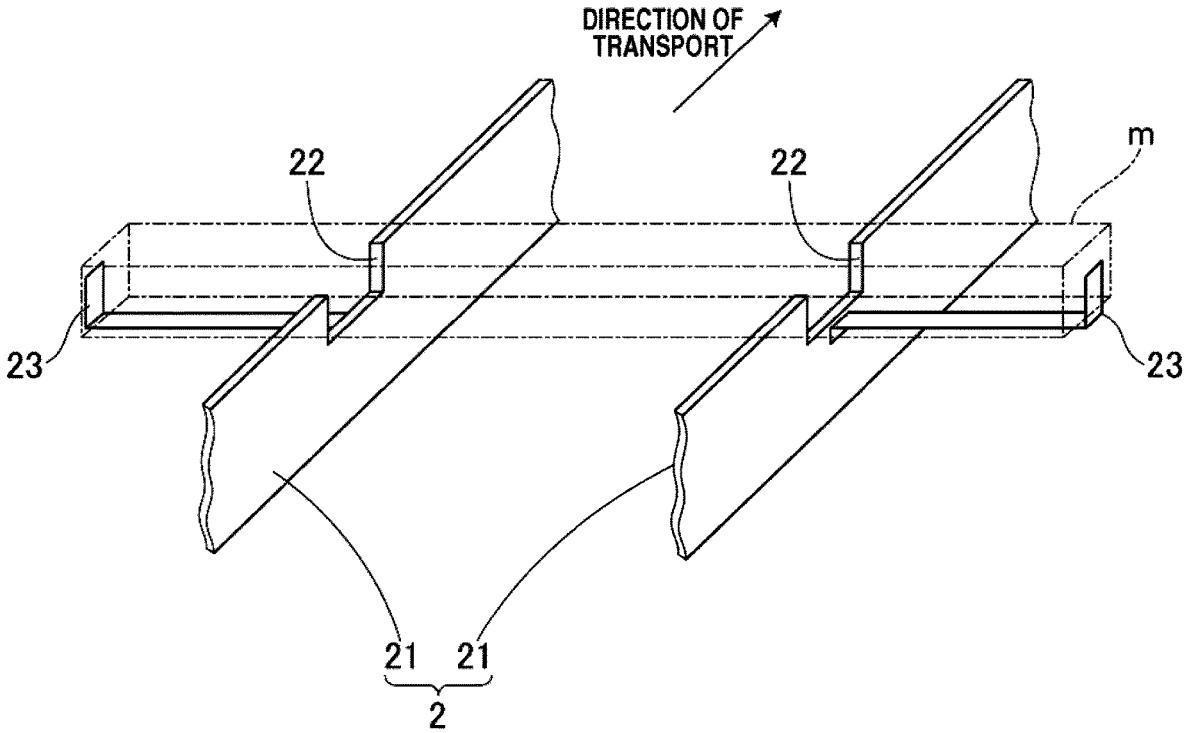
FIG. 8 is a fragmentary schematic perspective view illustrating another example of the fixed beam which constitutes the coating device.

Here, it is preferred, although not specifically illustrated in the drawings, to form a plurality of projections on each paired magnet body holding portions 22 so that the sintered magnet body m is placed and held on the projections. Such projections can prevent the fixed beam 2 and the sintered magnet bodies m from coming into contact with one another at surfaces thereof and can make smaller the areas of contact between them, so that more uniform coating of the slurry can be conducted. Although not particularly limited, as illustrated in FIG. 8, plate-shaped long stoppers 23 bent in a L-shape may be attached to outer side walls of the respective transport rails 21 at locations corresponding to the respective magnet body holding portions 22, and the sintered magnet bodies m may be held immobile at opposite ends thereof by free end portions of the stoppers 23 to prevent the sintered magnet bodies m from shifting in a horizontal direction that crosses the direction of transport at right angles.

The dimensions of each magnet body holding portion 22 may be set as appropriate according to the dimensions of each sintered magnet body m so that attachment and detachment of the sintered magnet body m can be performed easily without failure. For example, the width of each magnet body holding portion 22 may preferably be set at least 2 mm greater than the width of the sintered magnet body m, and the height of the magnet body holding portion 22 may be set preferably at least 1%, notably at least 10%, specifically at least 20% greater than the thickness of the sintered magnet body m. Further, the distance between each paired notches 22 that constitute the magnet body holding portions 22, in other words, the distance between the respective transport rails 21 may be set at preferably 20% or more, notably 50% to 80% of the length of the sintered magnet body m. If the respective transport rails 21 are arranged inside each paired supporting rods 31 of the moving beams 3 to be described subsequently herein, the respective transport rails 21 may preferably be arranged so that an inner section of the sintered magnet body m is supported by the respective transport rails 21, the inner section being inner than locations apart by 10% of the length dimension of the sintered magnet body m from the opposite ends of the sintered magnet body m (for example, locations apart by 10 mm from the opposite ends of the sintered magnet body m if the length of the sintered magnet body m is 100 mm). If the positions of the respective transport rails 21 are outer than the above-mentioned locations, the locations where the sintered magnet body m is supported by the moving beams 3 are too close to the opposite ends of the sintered magnet body m, resulting in a higher falling risk of the sintered magnet body m during its transport.

As illustrated in FIGS. 1 to 4, the fixed beam 2 is disposed horizontally, and sequentially extends through the slurry 1 inside the coating bath 11, the below-described residual drip removal zone 41 and the below-described drying zone 42. Here, a section of the fixed beam 2, the section being disposed in the coating bath 11, is formed as a discrete element separated from the remaining section, and is disposed in the coating bath 11 horizontally along the same track as the remaining section, and the magnet body holding portions 22 are provided consecutively at equal intervals without interruptions through the coating bath 11. Further, the fixed beam 2 in the coating bath 11 is immersed in the slurry contained in the coating bath 11.

As illustrated in FIGS. 5 to 7, the moving beams 3 are formed of pairs of supporting rods 31 that are each provided at a free end portion (lower end portion) thereof with a magnet body supporting portion 32 bent in a hook shape. These paired supporting rods 31 are consecutively provided at equal intervals corresponding to the magnet body holding portions 22 of the fixed beam 2 along and over the fixed beam 2. As illustrated in FIGS. 6 and 7, the moving beams 3 are configured so that each sintered magnet body m is supported by the magnet body supporting portions 32 of each paired supporting rods 31. The distance between each paired supporting rods 31 is set so that the sintered magnet body m can be stably supported between the respective magnet body supporting portions 32 and the respective magnet body supporting portions 32 can pass up and down inside or outside (inside in this embodiment) the respective transport rails 21 of the fixed beam 2.

The moving beams 3 are configured to move up and down and back and forth by an unillustrated drive mechanism above the fixed beam 2, and in accordance with operations to be described subsequently herein, to lift each sintered magnet body m from the magnet body holding portions 22 of the fixed beam 20 and to move it to the next magnet body holding portions 22. Details of this moving operation will be described subsequently herein.

Figure 9:
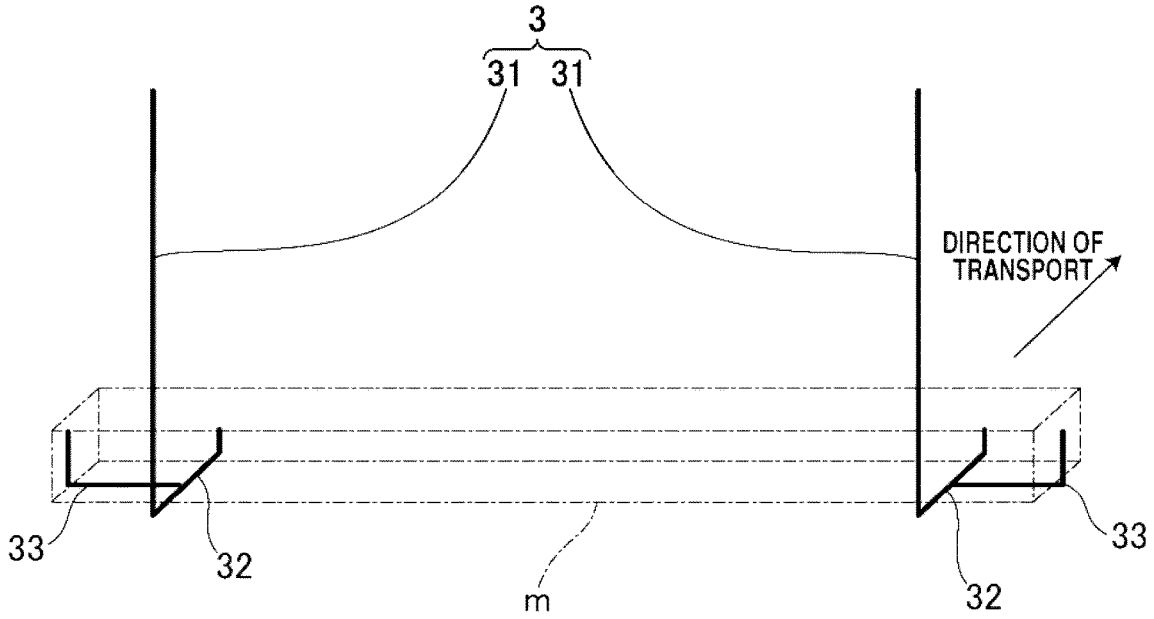
FIG. 9 is a fragmentary schematic perspective view illustrating another example of the moving beams which constitute the coating device.

Although not specifically limited, the moving beams 3 may be provided, as illustrated in FIG. 9, with rod-shaped stoppers 33 bent in an L-shape on outer walls of each paired magnet body supporting portions 32, individually, and may hold the sintered magnet body m immobile at the opposite ends thereof by free end portions of these stoppers 23 to prevent the sintered magnet body m from shifting in the horizontal direction that crosses the direction of transport at right angles. If these stoppers 33 are provided, the distance between each paired supporting rods 31 needs to be set sufficient to allow the respective magnet body supporting portions 32 to pass up and down outside the respective transport rails 21 of the fixed beam 2.

This coating device is configured to continuously transport the sintered magnet bodies m in accordance with transport operations to be described subsequently herein while using the fixed beam 2 and the moving beams 3. The speed of transport can be set as appropriate according to the form (size, shape) of the sintered magnet bodies m as objects of processing and the processing capacity required for the device, and is not specifically limited. The speed of transport may, however, be set at preferably 200 to 2,000 mm/minute, more preferably at 400 to 1,200 mm/minute. A speed of transport lower than 200 mm/minute can hardly achieve an industrially sufficient processing capacity, while a speed of transport in excess of 2,000 mm/minute is prone to the occurrence of insufficient drying during the processing in the residual drip removal zone and the drying zone both of which will be described subsequently herein, leads to a need for capsizing a blower or increasing the number of blowers to conduct reliable drying, and may develop inconvenience such as capacity enlargements of the residual drip removal zone and the drying zone.

A plurality of transport paths, which are each configured of the fixed beam 2 and the moving beams 3, may be disposed side by side in parallel to each other so that the below-described powder coating process from the coating of the slurry to the drying is concurrently conducted for the sintered magnet bodies m under transport in a plural number of rows. This configuration can substantially increase the processing capacity.

Numeral 41 in FIGS. 1 to 4 designates the residual drip removal zone that removes residual drips of the slurry 1 from the surfaces of the sintered magnet bodies m, and numeral 42 in FIGS. 1 to 4 indicates the drying zone that dries the sintered magnet bodies m to remove the solvent from the coated slurry 1 so that coatings of the powder of the rare earth compound or compounds are formed. The sintered magnet bodies m which are being transported by the fixed beam 2 and the moving beams 3 in accordance with the so-called walking beam system sequentially pass through the residual drip removal zone 41 and the drying zone 42 to apply the residual drip removal and drying operations to them.

The residual drip removal zone 41 and the drying zone 42 are provided with residual drip removal means (not illustrated) and drying means (not illustrated), in each of which air ejection nozzles are disposed to blow air against the sintered magnet bodies m which are being transported forward while being supported on the magnet body supporting portions 32 of the moving beams 3 and those which are being held on the magnet body holding portions 22 of the fixed beam 2. After air is ejected from the nozzles of the residual drip removal means against the sintered magnet body m under transport to remove residual drips, warm/hot air is ejected from the nozzles of the drying means to conduct drying.

Here, the temperature of the warm/hot air from the drying means is not particularly limited, and may be adjusted as appropriate within a range of ±50° C. of the boiling point ($T_B$) of the solvent, which forms the slurry 1, in accordance with the drying time (the speed of transport and the length of the drying zone), the size and shape of the sintered magnet bodies, and the concentration and coat weight of the slurry. If water is used as a solvent for the slurry, for example, the temperature of the warm/hot air may be adjusted within a range of 40° C. to 150° C., preferably 60° C. to 100° C. As the air to be ejected by the residual drip removal means, similar warm/hot air may also be used to accelerate the drying if necessary.

Further, the flow rate of the air or warm/hot air to be ejected from the nozzles of the residual drip removal means or the drying means is adjusted as appropriate in accordance with the speed of transport of the sintered magnet bodies m, the lengths of the residual drip removal zone 41 and the drying zone 42, the size and shape of the sintered magnet bodies m, and the concentration and coat weight of the slurry, and is not particularly limited. In general, however, it may be adjusted within a range of preferably 300 to 2,500 L/minute, notably 500 to 1,800 L/minute.

The residual drip removal zone (residual drip removal means) 41 is not necessarily an essential element, and can be omitted according to the circumstances. The removal of residual drips can be conducted concurrently with drying in the drying zone (drying means) 42. However, coating unevenness of the powder tend to occur if drying is conducted with residual drips still existing on surfaces of the sintered magnet bodies m. It is, therefore, preferred to conduct drying after residual drips have been fully removed in the residual drip removal zone (residual drip removal means) 41.

Designated at numeral 43 in FIGS. 1 to 4 is a chamber that encloses the residual drip removal zone 41 and the drying zone 42. It is preferred to provide dust collection means (not illustrated) for recovering the powder of the rare earth compound or compounds, which have been removed from the surfaces of the sintered magnet bodies m during removal of residual drips and drying, by enclosing the residual drip removal zone 41 and the drying zone 42 with the chamber 43 and drawing air inside the chamber 43 and recovering dust through an unillustrated dust collector. Owing to the provision of the dust collection means, the coating of the powder of the rare earth compound or compounds can be conducted without wasting the rare earth compound or compounds with the valuable rare earth element or elements contained therein. Further, the provision of the dust collection means can shorten the drying time, and also can prevent warm/hot air from flowing around into a slurry coating unit formed of the coating bath 11, piping, and a pump as much as possible, whereby evaporation of the slurry solvent with warm/hot air can be effectively avoided. The dust collector (not illustrated) may be either wet type or dry type. To ensure the achievement of the above-described advantageous effects, it is preferred to select a dust collector having suction ability greater than the ejection rate of air from the nozzles of the residual drip removal means 41 and the drying means 42.

With reference to FIGS. 1 to 4, a description will next be made about operations upon coating the surfaces of the sintered magnet bodies m with the powder (powder of rare earth compound or compounds), which contains one or more rare earth compounds selected from oxides, fluorides, oxyfluorides, hydroxides and hydrides of $R^2$ ($R^2$: one or more elements selected from rare earth elements including Y and Sc), by using the coating device.

Firstly, the slurry 1 in which the powder is dispersed in a solvent is placed in the coating bath 11, and by stirring the slurry 1 with the above-mentioned circulation mechanism as needed, the slurry 1 is brought into as a state that the powder is uniformly dispersed in the slurry 1. Here, the temperature of the slurry may be set, but is not specifically limited, at 10° C. to 40° C. in general. The amount of the slurry 1 in the coating bath 11 is set as appropriate according to the processing ability required for the device, and may be set at preferably at least 0.5 L, more preferably at least 1 L. An unduly small amount of the slurry 1 leads to an excessively high flow rate of circulation, so that a uniformly dispersed state may hardly be maintained in some instances. The circulation rate of the slurry 1 is set as appropriate according to the amount of the slurry 1. In general, however, the circulation rate of the slurry 1 may be set at preferably 1 to 10 L/minute, notably 4 to 8 L/minute.

Under these conditions, the sintered magnet bodies m are consecutively placed and supplied to the magnet body holding portions 22 on an upstream side (the left side in FIGS. 1 to 4) of the fixed beam 2, and at the same time, the moving beams 3 are operated to sequentially move the sintered magnet bodies m to the next magnet body holding portions 22 so that the sintered magnet bodies m are transported. This transport operation by the fixed beam 2 and the moving beams 3 is as will be described hereinafter. In the following description, the transport operation will be described with the sintered magnet bodies m (m1 to m8) having been already placed on the respective magnet body holding portions 22 of the fixed beam 2.

Firstly taking the state of FIG. 1(A) as an initial state, the individual moving beams 3 are located above the fixed beam 2 and between the respective magnet body holding portions 22 in this state (the state of FIG. 5). From this state, the moving beams 3 are lowered (see arrows in FIG. 1(B)) into a state that as indicated in FIG. 1(B), the magnet body supporting portions 32 of the individual moving beams 3 are located between and below the magnet body holding portions 22.

Figure 1B:
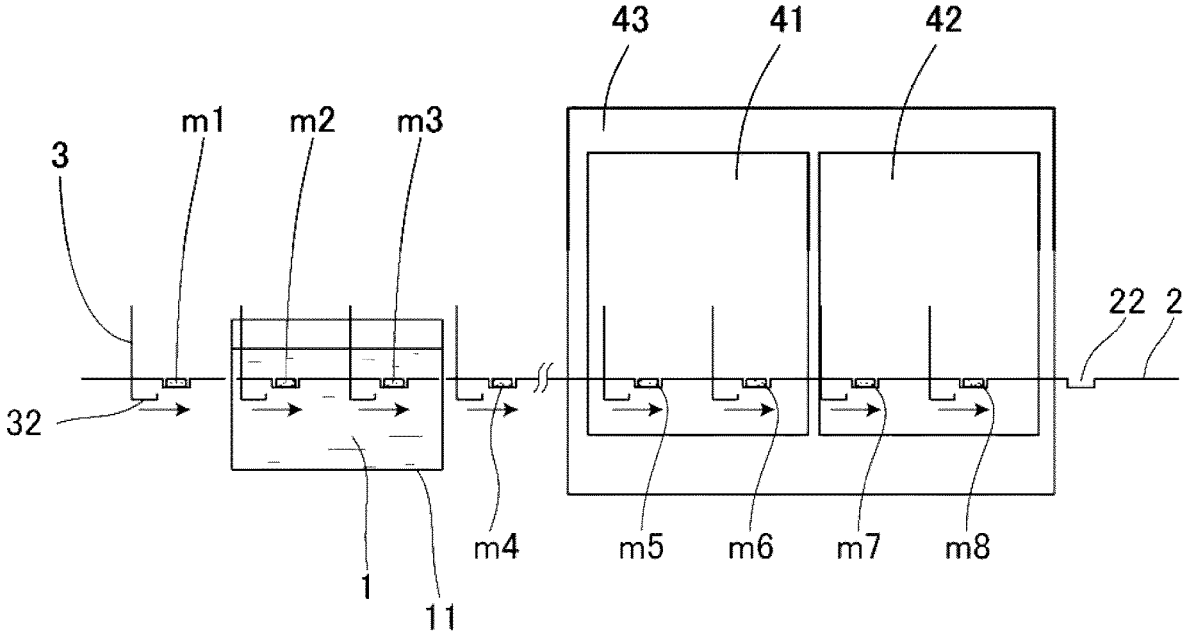
Figure 2C:
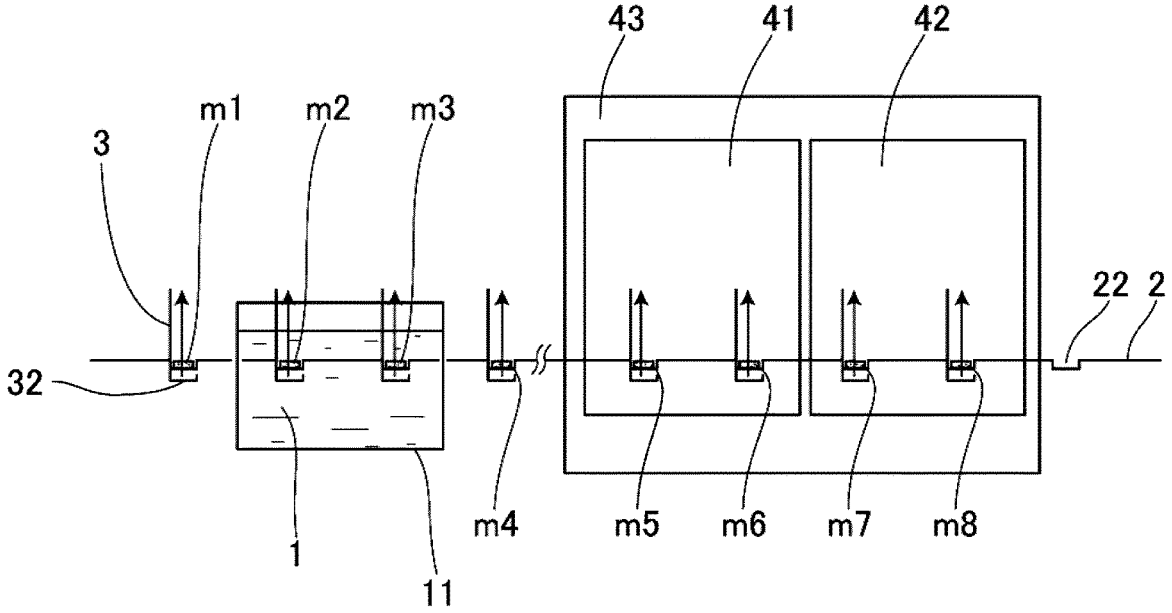

As indicated by arrows in FIG. 1(B), the individual moving beams 3 are moved forward (toward a downstream side as viewed in the direction of transport; rightward in FIGS. 1 to 4), so that as illustrated in FIG. 2(C), the individual magnet body supporting portions 32 are located right underneath the sintered magnet bodies m1 to m8 held on the magnet body holding portions 22 (the state of FIG. 6). In this state, the moving beams 3 are moved upward (see the arrows in FIG. 2(C)). As a consequence, as illustrated in FIG. 2(D), the individual sintered magnet bodies m1 to m8 are supported and lifted by the corresponding magnet body supporting portions 32 of the moving beams 3, and are brought into a state that they are held by the moving beams 3 at locations a predetermined distance upwardly apart from the fixed beam 2 (the state of FIG. 7).

Figure 2D:
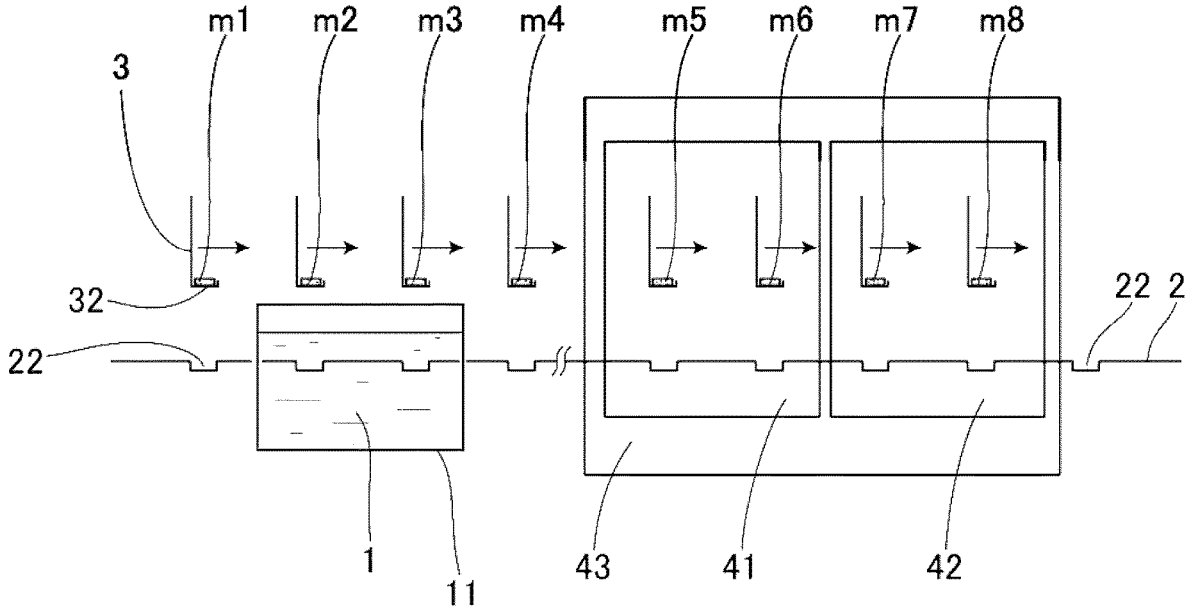
Figure 3E:
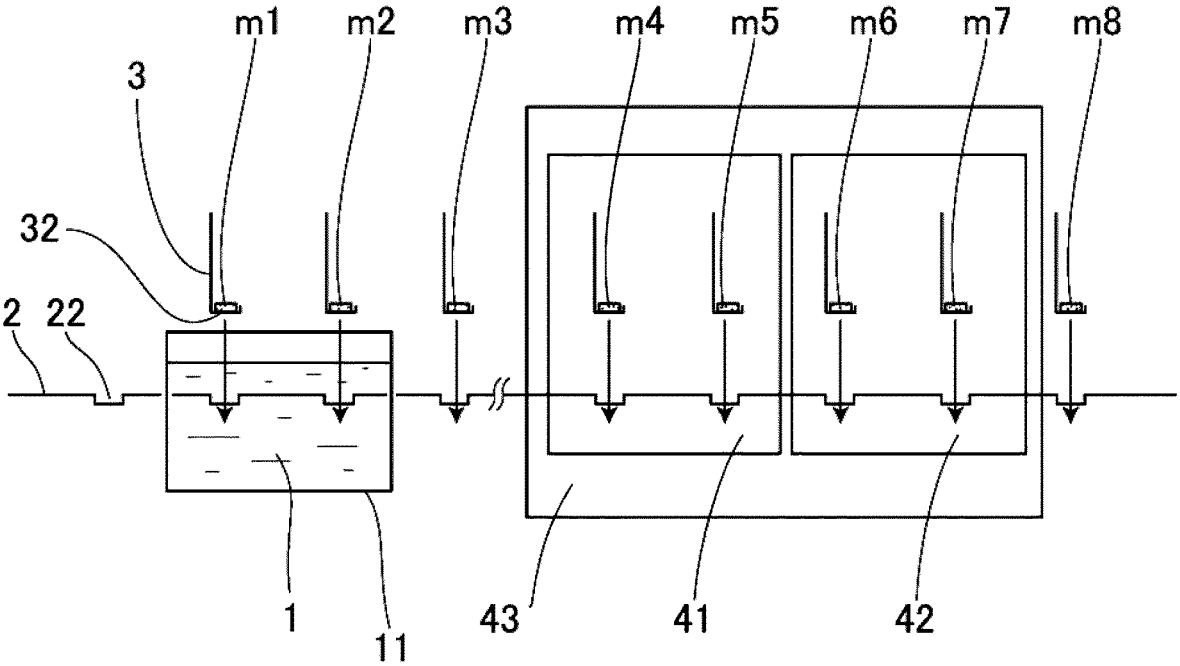

With the individual sintered magnet bodies m1 to m8 being kept lifted as described above, the moving beams 3 are moved forward as indicated by arrows in FIG. 2(D), and the individual sintered magnet bodies m1 to m8 are positioned right above the next magnet body holding portions 22 as illustrated in FIG. 3(E). At this time, the sintered magnet body m1 which has been located on an upstream side of the coating bath 11 as viewed in the direction of transport moves to above the coating bath 11, the sintered magnet body m3 which has been dipped in the slurry 1 in the coating bath 11 is pulled out of the slurry 1 and moves toward a downstream side of the coating bath 11 as viewed in the direction of transport, the sintered magnet body m4 which has been in a state of having been pulled out of the slurry 1 moves to the residual drip removal zone 41, the sintered magnet body m6 on which removal of residual drips has been conducted in the residual drip removal zone 41 moves to the drying zone 42, and the sintered magnet body m8 to which drying processing has been applied in the drying zone 42 is taken out of the drying zone 42 and moves toward the downstream side as viewed in the direction of transport.

Figure 3F:
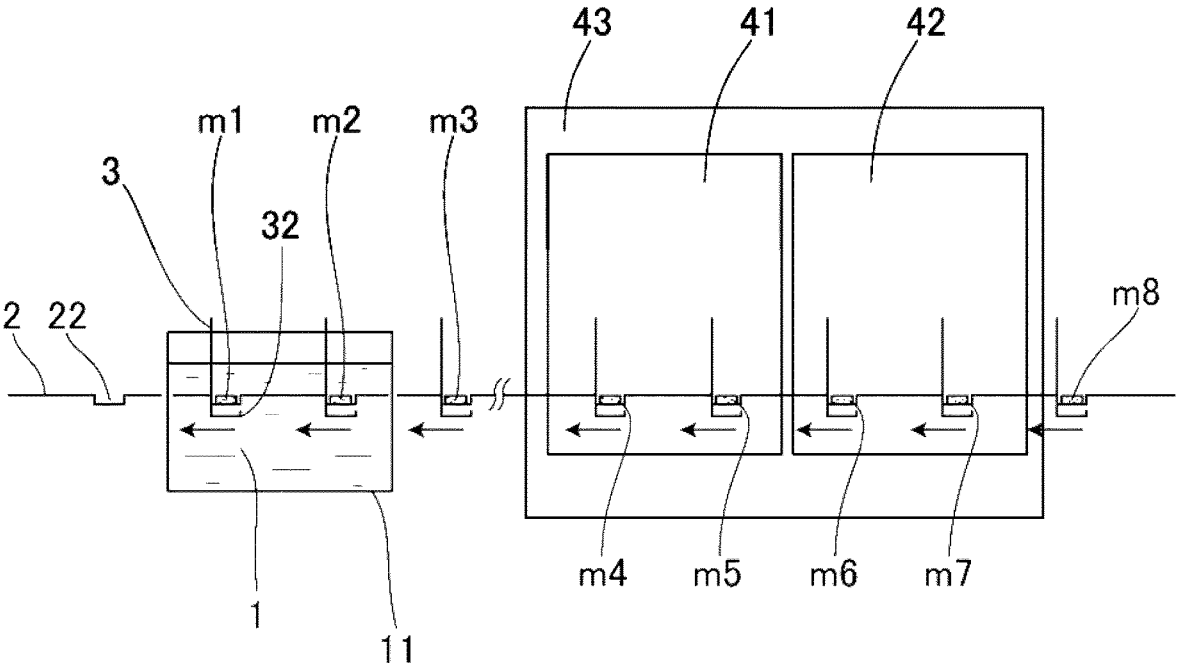

Then, as indicated by arrows in FIG. 3(E), the moving beams 3 are lowered, the individual sintered magnet bodies m1 to m8 are placed and held on the next magnet body holding portions 22 as illustrated in FIG. 3(F), and further, the individual magnet body supporting portions 32 of the moving beams 3 are lowered to locations a predetermined distance downwardly apart from the corresponding magnet body holding portions 22. As a consequence, the sintered magnet body m1 is placed and held on the magnet body holding portions 22 disposed in the coating bath 11 and immersed in the slurry 1, and therefore is brought into a state of being dipped in the slurry 1, the sintered magnet body m4 is placed and held on the magnet body holding portions 22 in the residual drip removal zone 41 and is subjected to the removal of residual drips, the sintered magnet body m6 is placed and held on the magnet body holding portions 22 in the drying zone 42 and is subjected to the drying processing, and the sintered magnet body m8 has finished the entire coating processing and is placed and held on the magnet body holding portions 22 located most downstream as viewed in the direction of transport.

Figure 4G:
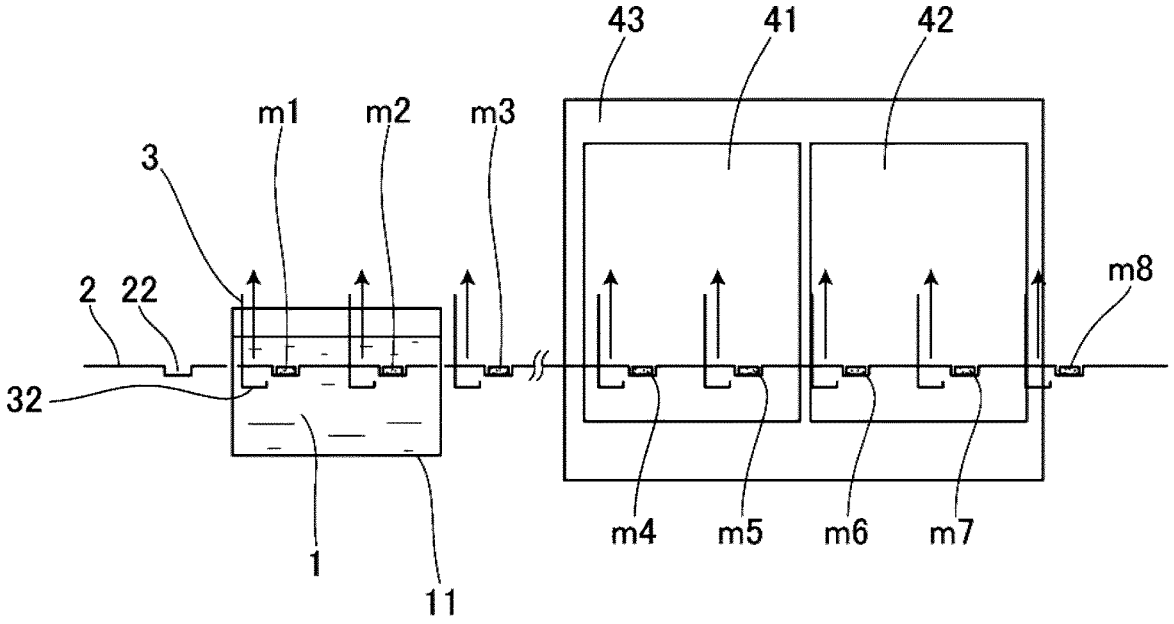

As indicated by arrows in FIG. 3(F), the moving beams 3 are next moved backward (toward the upstream side as viewed in the direction of transport: leftward in FIGS. 1 to 4), and as illustrated in FIG. 4(G), the moving beams 3 are located between the magnet body holding portions 22. In this state, the moving beams 3 are moved upward (see arrows in FIG. 4(G)), and as illustrated in FIG. 4(H), the moving beams 3 are lifted to a location a predetermined distance apart above the fixed beam 2. As a consequence, the magnet body supporting portions 32 of the moving beams 3, which were immersed in the slurry 1, have been pulled upward from an upper end surface of the coating bath 11.

Figure 4H:
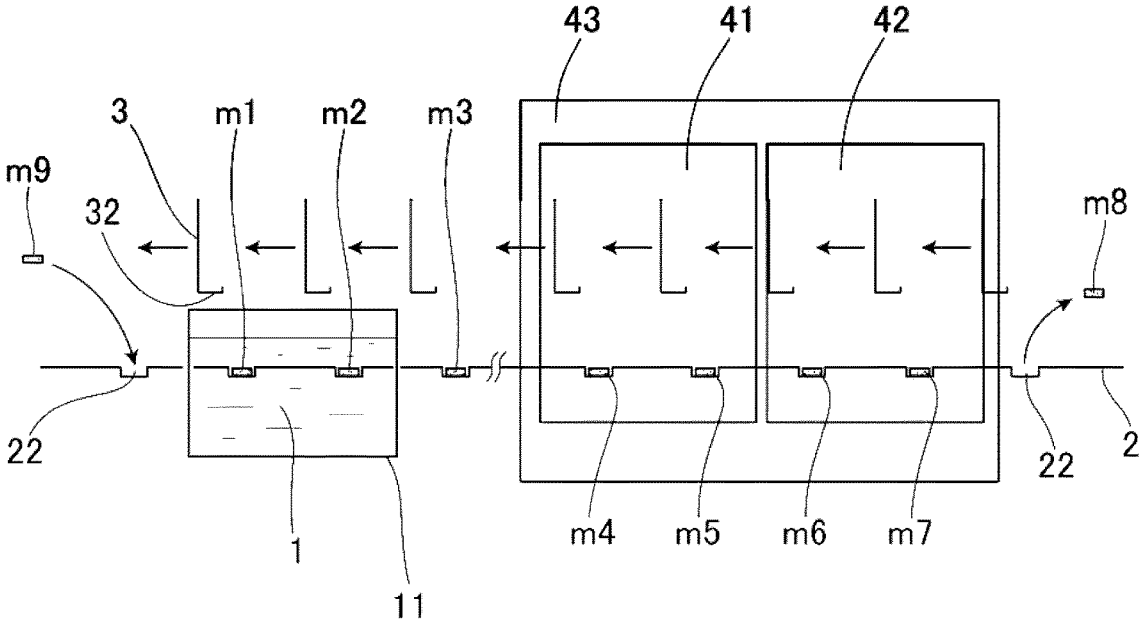

As indicated by arrows in FIG. 4(H), the moving beams 3 are moved backward (toward the upstream side as viewed in the direction of transport; leftward in FIGS. 1 to 4) from the above-described state to return to the initial state illustrated in FIG. 1(A). At the same time, the sintered magnet body m8 which has finished the coating processing is collected from the magnet body holding portions 22 located most downstream as viewed in the direction of transport, and a fresh sintered magnet body m9 is placed on and supplied to the magnet body holding portions 22 which are located most upstream as viewed in the direction of transport and have been vacated as a result of the forward transport of the sintered magnet body m1. The above-described operations (A) to (H) illustrated in FIGS. 1 to 4 are then repeated to transport the sintered magnet bodies m along the fixed beam 2. In the course of the transport, the sintered magnet bodies m are passed through the slurry 1 to coat them with the slurry 1. While transporting the sintered magnet bodies m, residual drips are removed in the residual drip removal zone 41 and the resulting sintered magnet bodies m are dried in the drying zone 42, whereby the sintered magnet bodies m are consecutively coated with the powder.

In the present invention, rare earth permanent magnets are obtained by subjecting the sintered magnet bodies m, which have been coated with the powder of the one or more rare earth compounds and have been collected from the magnet body holding portions 22 of the fixed beam 2, to heat treatment to cause absorptive diffusion of $R_2$, which are contained in the one or more rare earth compounds, into the sintered magnet bodies as described above.

Here, by repeating the coating operation of the one or more rare earth compounds with the above-described coating device, the powder of the one or more rare earth compounds can be coated repeatedly. As a consequence, a thicker coating film can be obtained with further improved uniformity. For the repetition of the coating operation, the sintered magnet bodies can be passed a plurality of times through the single coating device to repeat the coating operation. As an alternative, taking the above-described coating device as one module, for example, two to ten modules may be arranged in series according to the thickness of a desired coating film, and the above-described powder coating process from the slurry coating to the drying may then be repeated as many times as the number of the modules. For the transfer between the individual modules in this modification, the sintered magnet bodies m may be moved to the fixed beam 2 in the next module by using moving transfer beams or another robot. As a further alternative, a transfer mechanism of a walking beam system, which is provided with the fixed beam 2 and the moving beams 3, may be adopted as a common facility configured to extend between each two adjacent modules. By passing the sintered magnet bodies m through the modules while using the fixed beam 2 and the moving beams 3, the powder coating process may be repeated a plurality of times.

By repeating the powder coating process from the slurry coating to the drying a plurality of times to conduct repeated coating of thin layers, a coating film can be formed with a desired thickness. The repeated coating of thin layers makes it possible to shorten the drying time and hence to improve the time efficiency. If the coating operation is repeated with a single coating device or if the sintered magnet bodies m are transferred between the fixed beams 2 in each two adjacent modules, the points of contact of the sintered magnet bodies m with each fixed beam 2 and its associated moving beams 3 change whenever transferred. Owing to the combination of the advantageous effect available from the avoidance of such changes in the points of contact and the advantageous effect available from the repeated coating of thin layers, the resulting coating film is provided with still further improved uniformity.

According to the production method of the present invention that the coating of a powder of one or more rare earth compounds is conducted using the above-described coating device, it is configured to transport the sintered magnet bodies m by the above-described walking beam system so that the dipping in the slurry 1, the removal of residual drips and the drying are sequentially conducted. Therefore, the individual sintered magnet bodies m are subjected to the dipping processing, the removal of residual drips and the drying processing while stably held on the magnet body holding portions 22 provided consecutively at equal intervals on and along the fixed beam 2. As a consequence, the dipping processing can be conducted with the sintered magnet bodies m being fully restrained from movements and almost fixed even during their coating with the slurry 1 by passing them through the slurry 1. It is, therefore, possible to fully avoid mutual contact of the sintered magnet bodies m, to surely prevent the occurrence of uncoated parts due to such contact, and also to coat the slurry uniformly without failure.

The transport of the sintered magnet bodies m is performed by an operation of the moving beams 3, these moving beams 3 can be formed from a wire material such as a metal wire, and moreover the moving beams to be submerged into the slurry for the dipping of the sintered magnet bodies can be limited to only a few ones of the moving beams (three moving beams in FIGS. 1 to 4. Accordingly, the amount of the slurry 1 to be carried out of the coating bath 11 by the transport operation can be reduced to extremely small, so that wasteful consumption of the slurry 1 can be prevented as much as possible and mechanical troubles of the transport system due to sticking and deposit of the slurry 1 and powder can be decreased. Further, the three moving beams 3, which submerge into the slurry 1, enter neither the residual drip removal zone 41 nor the drying zone 42, whereby the sticking and deposit of the slurry 1 and powder can be prevented extremely effectively.

According to the above-described coating device and the above-described method for producing rare earth magnets by using the coating device, the following advantageous effects can be obtained.

Figure 10:
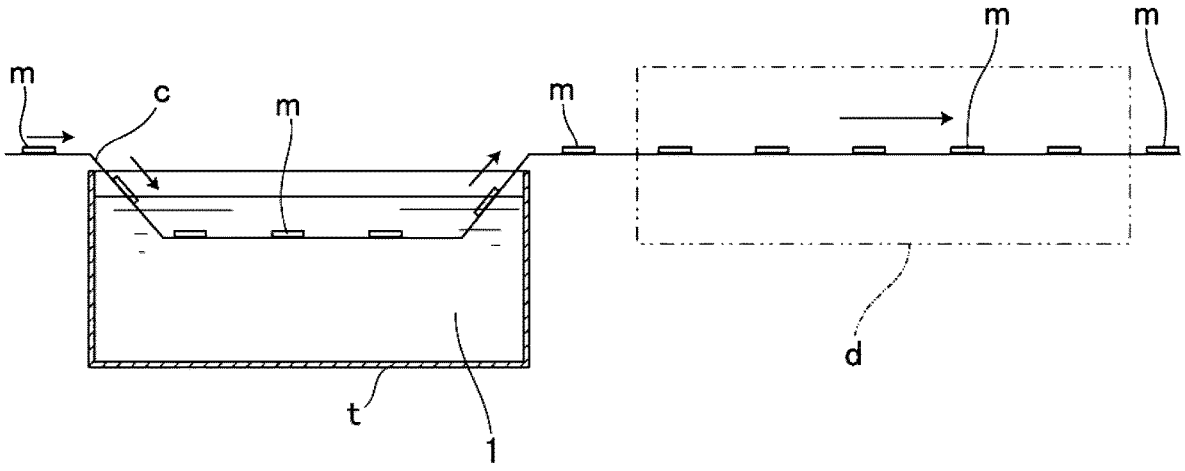
FIG. 10 is a schematic view illustrating a conventional coating device that uses a net conveyor.

1) Unlike the conveyor system such as that illustrated in FIG. 10, it is unnecessary to conduct the submergence and exit of the sintered magnet bodies m into and from the slurry by arranging inclined slope parts on the transport path. It is, therefore, sufficient if the coating bath 11 is dimensioned to have a capacity required corresponding to a processing capacity. It is, hence, possible to design smaller the coating bath 11 and a slurry circulation system which is formed of piping and a pump and may be provided as needed.
2) The removal step of residual drips and the drying step are free of any barrier against blowing of air, such as a conveyor belt like a net belt as seen in the conveyor system, and therefore the drying speed can be increased. As a consequence, a drying area that also includes the residual drip removal zone 41 can be designed small.
3) Because both the coating bath zone and the drying zone can be made small for the above reasons 1) and 2), the entire device can be designed small. Upon arrangement of a plurality of modules which are each formed of the device, the freedom of layout can be widened.

As mentioned above, the present invention can efficiently produce rare earth magnets with excellent magnetic properties including favorably-increased coercivity by subjecting sintered magnet bodies, which have been uniformly coated with the powder, to heat treatment to cause absorptive diffusion of the one or more rare earth elements represented by $R^2$ in the above-described manner.

The heat treatment, which causes absorptive diffusion of the above-described one or more rare earth elements represented by $R^2$, can be conducted by a known method. After the above-described heat treatment, known post-treatment can be applied as needed, for example, aging treatment can be applied under appropriate conditions, and further the rare earth magnets can be ground into a practical shape.

EXAMPLES

About more specific aspects of the present invention, a detailed description will hereinafter be made based on Examples. It should, however, be noted that the present invention shall not be limited to the Examples.

Examples 1 to 3

An alloy in thin plate form was prepared by a strip casting technique, specifically by weighing Nd, Al, Fe and Cu metals having a purity of at least 99 wt %, Si having a purity of 99.99 wt %, and ferroboron, high-frequency heating in an argon atmosphere for melting, and casting the alloy melt on a copper single roll. The alloy consisted of 14.5 at % of Nd, 0.2 at % of Cu, 6.2 at % of B, 1.0 at % of Al, 1.0 at % of Si, and the balance of Fe. Hydrogen decrepitation was carried out by exposing the alloy to 0.11 MPa of hydrogen at room temperature to occlude hydrogen and then heating at 500° C. for partial dehydriding while evacuating to vacuum. The decrepitated alloy was cooled and sieved, yielding a coarse powder under 50 mesh.

The coarse powder was finely pulverized into a powder having a weight median particle size of 5 μm in a jet mill that used high-pressure nitrogen gas. The resulting mixed fine powder was formed into block-shaped green compacts under a pressure of approximately 1 ton/cm$^2$ while allowing its particles to orient in a magnetic field of 15 kOe under a nitrogen gas atmosphere. The green compacts were placed in a sintering furnace under an Ar atmosphere, and were sintered at 1,060° C. for two hours to obtain magnet blocks. After the magnet blocks were subjected to full-surface grinding with a diamond cutter, the resulting magnet blocks were cleaned with an alkaline solution, deionized water, nitric acid and deionized water in this order, followed by drying to obtain block-shaped magnet bodies of 50 mm×20 mm×5 mm (in the direction of magnetic anisotropy).

Next, a powder of dysprosium fluoride was mixed at a mass fraction of 40% in water, followed by thorough dispersion of the powder of dysprosium fluoride to prepare a slurry. Using the above-described coating device illustrated in FIGS. 1 through 7, the above-described magnet bodies were coated with the slurry, and the resulting magnet bodies were dried to form coating films of the powder of dysprosium fluoride. Coating conditions were as follows.

Coating Conditions
Capacity of coating bath 11: 1 L
Circulation flow rate of slurry: 6 L/minute
Speed of transport: 700 mm/minute
Flow rate of air during drip removal and drying: 1,000 L/minute
Temperature of warm/hot air during drying: 80° C.
Number of magnet bodies subjected to powder coating: 100 forms The slurry spilled out of the coating bath during the processing of the 100 magnet bodies was collected. After drying, its weight was measured. The weight so measured was recorded as the amount of the slurry carried out of the coating bath. In addition, the number of block-shaped magnet bodies, which came into contact with one another at surfaces thereof after the coating, was also determined. The results are presented in Table 1.

The magnet bodies with a thin film of the powder of dysprosium fluoride formed on the surfaces thereof were subjected to heat treatment at 900° C. for five hours in an Ar atmosphere, whereby absorption processing was applied. Further, the resulting magnet bodies were subjected to aging treatment at 500° C. for one hour, and were then quenched to obtain rare earth magnets. Those magnets all had good magnetic properties.

Comparative Example

In a similar manner as in the Examples, block-shaped magnet bodies of 50 mm×20 mm×5 mm (in the direction of magnetic anisotropy) were prepared. Further, dysprosium fluoride (average powder particle size: 0.2 μm) was mixed at a mass fraction of 40% in water, followed by thorough dispersion of dysprosium fluoride to prepare a slurry. The slurry was placed in the coating bath t of the conventional coating device illustrated in FIG. 10. The conventional coating device was used, and the speed of transport by the net conveyor c, and the conditions for residual drip removal and drying in the drying zone d were adjusted to make the coating conditions equivalent to those in Example 1, and coating of dysprosium fluoride was conducted. Specifications of a net belt employed in the net conveyor c were as follows.

<Specifications of Net Belt>
Type: conveyor belt
Shape: triangular spiral type
Spiral pitch: 8.0 mm
Rod pitch: 10.2 mm
Diameter of rods: 1.5 mm
Diameter of spirals: 1.2 mm In a similar manner as in the Examples, the amount of the slurry carried out of the coating bath was measured. In addition, the number of block-shaped magnet bodies, which came out of the drying zone d while being in contact with one another at surfaces thereof after the coating, was also determined. The results are presented in Table 1. The amount of the slurry is presented as an index number with the carry-out amount in Example 1 being assumed to be 1.

In a similar manner as in the Examples, the magnet bodies with a thin film of the powder of dysprosium fluoride formed on the surfaces thereof were subjected to heat treatment at 900° C. for five hours in an Ar atmosphere, whereby absorption processing was applied. Further, the resulting magnet bodies were subjected to aging treatment at 500° C. for one hour, and were then quenched to obtain rare earth magnets.

TABLE 1

| | Amount of slurry carried out of coating bath (index number with the carried-out amount in Example 1 being assumed to be 1) | Number of magnet bodies which came out while being in contact at surfaces thereof (forms) |
|---|---|---|
| Example | 1 | 0 |
| Comparative Example | 4.25 | 2 |

As presented in Table 1, it is understood, from a comparison between the amounts of the slurry carried out of the coating bath, that the coating device, which was used in the Examples and conducted coating operations while transporting magnet bodies by the walking beam system, was as much as approximately 76% smaller in the carried-out amount of the slurry than the Comparative Example which used the transport means of the net conveyor system. As also depicted in Table 1, concerning the number of block-shaped magnet bodies which came out while being in contact with one another at the surfaces thereof, there was absolutely no block-shaped magnet body by the walking beam system of the present invention (the Examples). It has, therefore, been confirmed that the coating of a powder can be favorably conducted according to the present invention.

REFERENCE SIGNS LIST

1 slurry
11 coating bath
2 fixed beam
21 transport rail
22 magnet body holding portion (square u-shaped notch)
23 stopper
3 moving beam
31 supporting rod
32 magnet body supporting portion
33 stopper
41 residual drip removal zone (residual drip removal means)
42 drying zone (drying means)
43 chamber
m, m1 to m9 sintered magnet body
c net conveyor
t coating bath in conventional coating device
d drying zone in conventional coating device

The invention claimed is:

1. A device for coating sintered magnet bodies of an $R^1$—Fe—B composition, where $R^1$ is one or more elements selected from rare earth elements including Y and Sc, with a powder of one or more rare earth compounds selected from oxides, fluorides, oxyfluorides, hydroxides and hydrides of R, where $R^2$ is one or more elements selected from rare earth elements including Y and Sc, in production method of rare earth permanent magnets by coating the sintered magnet bodies with a slurry of the powder dispersed in a solvent, drying the resulting sintered magnet bodies to coat surfaces of the sintered magnet bodies with the powder, and subjecting the resulting sintered magnet bodies to heat treatment to cause absorption of $R^2$ into the sintered magnet bodies, the device comprising:

a coating bath for containing the slurry therein;

a fixed beam having a plurality of magnet body holding portions, which are provided consecutively at equal intervals and on which the sintered magnet bodies are to be placed, and disposed so that a section of the fixed beam extends through the slurry contained in the coating bath;

a plurality of moving holders for lifting up the sintered magnet bodies placed on the respective magnet body holding portions from the fixed beam, moving the sintered magnet bodies forward, and placing the sintered magnet bodies on the next magnet body holding portions; and dryer for drying the sintered magnet bodies held on the magnet body holding portions of the fixed beam, wherein the fixed beam is arranged to extend from the coating bath to the dryer, so that the coating bath is disposed upstream and the dryer is disposed downstream, each of the moving holders is arranged to i) hold and lift up one of the sintered magnet bodies at one of the magnet body holding portions form the fixed beam, ii) move said one of the magnet bodies forward and place the same at another magnet holding portion downstream of the fixed beam, and iii) return to said one of the magnet holding portions to hold and lift another of the sintered magnet bodies from the fixed beam, the coating bath, the fixed beam, and the moving holders are arranged so that the sintered magnet bodies are transported along the fixed beam by repeating operations of placing the sintered magnet bodies on the respective magnet body holding portions of the fixed beam, and by the moving holders, lifting up the sintered magnet bodies placed on the respective magnet body holding portions from the fixed beam, moving the sintered magnet bodies forward and placing the sintered magnet bodies on the next magnet body holding portions, the individual sintered magnet bodies are passed through the slurry, which is contained in the coating bath, in a course of the transport thereof to coat the sintered magnet bodies with the slurry, and the resulting sintered magnet bodies are moved by the moving holder to the dryer to remove the solvent from the coated slurry to deposit the powder on surfaces of the sintered magnet bodies.

2. The coating device of claim 1, further comprising:

residual drip removal means disposed between the coating bath and the dryer to eject air against each sintered magnet body under transport while sequentially moving from one to the next of the magnet body holding portions of the fixed beam so that residual drips of the slurry on the surface of the sintered magnet body are removed.

3. The coating device of claim 1 or 2, further comprising:

a chamber enclosing therein a drying zone with the dryer disposed therein or both the drying zone and a residual drip removal zone with the residual drip removal means disposed therein; and dust collection means for drawing air inside the chamber to collect dust, whereby the powder of the one or more rare earth compounds removed from the surfaces of the sintered magnet body is recovered.

4. The coating device of claim 1, wherein a plurality of modules, which each include the coating bath and the dryer, are disposed in series, and are configured so that a powder coating process from the coating of the slurry to the drying is repeated a plural number of times by passing the sintered magnet bodies through the plurality of modules by transport means formed of the fixed beam and the moving holders.

5. The coating device of claim 1, wherein each magnet body holding portion includes a recessed portion formed in the fixed beam, and a plurality of projections formed on the recessed portion so that one of the sintered magnet bodies is held in the recessed portion while being placed on the projections.

6. The coating device of claim 1, wherein the fixed beam is formed of a plurality of transport rails disposed in parallel to each other along a direction of transport, and the magnet body holding portions are formed astride the plurality of transport rails, and hold the sintered magnet bodies.

7. The coating device of claim 6, wherein the moving holders include a plural number of paired supporting rods, and each paired supporting rods each have a magnet body supporting portion bent in a hook shape, and the moving holders are configured to repeat operations of moving the supporting rods up and down and moving the supporting rods back and forth along the fixed beam, lifting the sintered magnet bodies placed on the respective magnet body holding portions of the fixed beam, moving the sintered magnet bodies forward, and placing the sintered magnet bodies on the next magnet body holding portions.

8. The coating device of claim 6 or 7, wherein the magnet body holding portions of the fixed beam or the magnet body supporting portions of the moving holders or both the magnet body holding portions of the fixed beam and the magnet body supporting portions of the moving holders are each provided with a stopper that prevents one of the sintered magnet bodies from shifting in a horizontal direction that crosses the direction of transport at right angles.

9. The coating device of claim 1, wherein a plurality of transport paths, which are each configured of the fixed beam and the moving holders, are disposed side by side in parallel to each other, and are configured so that a powder coating process from the coating of the slurry to the drying is concurrently conducted for the sintered magnet bodies transported in a plural number of rows.

* * * * *